US009222762B2

(12) United States Patent
Dillard et al.

(10) Patent No.: US 9,222,762 B2
(45) **Date of Patent: *Dec. 29, 2015**

(54) DECOYS FOR INFRA-RED RADIATION SEEKING MISSILES AND METHODS OF PRODUCING AND USING THE SAME

(71) Applicant: ALLOY SURFACES COMPANY, INC., Chester Township, PA (US)

(72) Inventors: David Dillard, New Castle, DE (US); Jason A. Fischer, Rising Sun, MD (US); Rajesh D. Shah, Princeton, NJ (US); John J. Scanlon, Mount Laurel, NJ (US); Eric M. Smith, Richboro, PA (US); Truong Quang Dinh, Drexel Hill, PA (US); David L. Machamer, Phoenixville, PA (US)

(73) Assignee: ALLOY SURFACES COMPANY, INC., Chester Township, PA (US)

( * ) Notice: Subject to any disclaimer, the term of this patent is extended or adjusted under 35 U.S.C. 154(b) by 165 days.

This patent is subject to a terminal disclaimer.

(21) Appl. No.: 13/632,668

(22) Filed: Oct. 1, 2012

(65) Prior Publication Data

US 2014/0208973 A1 Jul. 31, 2014

Related U.S. Application Data

(60) Continuation of application No. 13/189,266, filed on Jul. 22, 2011, now Pat. No. 8,276,518, which is a division of application No. 12/205,987, filed on Sep. 8, 2008, now Pat. No. 7,992,496, which is a continuation-in-part of application No. 11/411,275, filed on Apr. 26, 2006, now Pat. No. 7,421,950.

(60) Provisional application No. 60/675,544, filed on Apr. 28, 2005.

(51) Int. Cl.

| | |
|---|---|
| ***F42B 12/70*** | (2006.01) |
| ***F42B 12/36*** | (2006.01) |
| ***F42B 4/26*** | (2006.01) |
| ***F41J 2/02*** | (2006.01) |

(52) U.S. Cl.

CPC . *F42B 12/70* (2013.01); *F41J 2/02* (2013.01); *F42B 4/26* (2013.01); *F42B 12/36* (2013.01)

(58) Field of Classification Search

CPC ..... F42B 4/26; F42B 5/15; F42B 12/70; F42B 12/36; F41J 2/02

USPC ..... 102/335, 336, 342, 345, 351, 357, 360, 102/504, 505

See application file for complete search history.

(56) References Cited

U.S. PATENT DOCUMENTS

| | | | |
|---|---|---|---|
| 3,095,814 | A | 7/1963 | Jansen et al. |
| 4,435,481 | A | 3/1984 | Baldi |
| 4,621,579 | A | 11/1986 | Badura et al. |
| 4,838,167 | A | 6/1989 | Prahauser et al. |
| 4,895,609 | A | 1/1990 | Baldi |
| 4,957,421 | A | 9/1990 | Baldi |
| 5,182,078 | A | 1/1993 | Baldi |

(Continued)

*Primary Examiner* — James S Bergin

(74) *Attorney, Agent, or Firm* — Novak Druce Connolly Bove + Quigg LLP

(57) ABSTRACT

The present invention relates to decoys for heat-seeking missiles and methods of producing and using the same. The decoys axe designed to be kinematic or pseudo-kinematic, producing one or more infra-red radiation emitting clouds that give the appearance of a moving infra-red target in the airspace in which the decoy has been released.

18 Claims, 10 Drawing Sheets

(56) References Cited

U.S. PATENT DOCUMENTS

| | | | |
|---|---|---|---|
| 5,499,582 | A | 3/1996 | Schiessl et al. |
| 5,631,441 | A | 5/1997 | Briere et al. |
| 5,866,840 | A | 2/1999 | Briere et al. |
| 5,915,964 | A | 6/1999 | Walia |
| 6,055,909 | A | 5/2000 | Sweeny |
| 6,093,498 | A | 7/2000 | Baldi |
| 6,193,814 | B1 | 2/2001 | Baldi |
| 6,499,407 | B2 | 12/2002 | Brum |
| 6,662,700 | B2 | 12/2003 | O'Neill |
| 6,666,351 | B1 | 12/2003 | Hartz et al. |
| 7,343,861 | B1 | 3/2008 | Baker |
| 7,373,886 | B2 | 5/2008 | Zatterqvist et al. |
| 7,421,950 | B2 | 9/2008 | Dillard et al. |
| 7,441,503 | B1 | 10/2008 | Callaway |
| 7,516,700 | B1 | 4/2009 | Callaway |
| 7,584,702 | B1 | 9/2009 | Sutherland et al. |
| 7,600,477 | B2 | 10/2009 | Zatterqvist |
| 7,617,776 | B1 | 11/2009 | Parker et al. |
| 7,640,858 | B1 | 1/2010 | Herbage et al. |
| 7,992,496 | B2 | 8/2011 | Dillard et al. |
| 8,276,518 | B2 * | 10/2012 | Dillard et al. ..... 102/342 |
| 9,067,844 | B2 * | 6/2015 | Lay ..... 1/1 |
| 2009/0050245 | A1 * | 2/2009 | Lay ..... 149/5 |

* cited by examiner

DECOYS FOR INFRA-RED RADIATION SEEKING MISSILES AND METHODS OF PRODUCING AND USING THE SAME

CROSS-REFERENCE TO RELATED APPLICATION(S)

This application is a continuation of U.S. patent application Ser. No. 13/189,266 filed Jul. 22, 2011 (now U.S. Pat. No. 8,276,518). U.S. patent application Ser. No. 13/189,266 is a divisional of U.S. patent application Ser. No. 12/205,987 filed Sep. 8, 2008 (now U.S. Pat. No. 7,992,496). U.S. patent application Ser. No. 12/205,987 is a continuation-in-part of U.S. patent application Ser. No. 11/411,275 filed on Apr. 26, 2006, which issued to U.S. Pat. No. 7,421,950 on Sep. 9, 2008. U.S. patent application Ser. No. 11/411,275 claimed the benefit of the filing date of U.S. Provisional Application No. 60/675,544 filed on Apr. 28, 2005.

BACKGROUND OF THE INVENTION

1. Field of the Invention

The present invention relates to decoys for heat-seeking missiles and methods of producing and using the same. The decoys are designed to be kinematic or pseudo-kinematic, producing one or more infra-red radiation emitting clouds that give the appearance of a moving infra-red target in the airspace in which the decoy has been released.

2. Description of Related Art

The Special Materials that are discussed and referenced is the present application are known to those of skill in the art and are described, for example, in the following U.S. patents, the complete disclosures of which are expressly incorporated herein, by reference: U.S. Pat. No. 4,435,481; U.S. Pat. No. 4,895,609; U.S. Pat. No. 4,957,421; U.S. Pat. No. 5,182,078; U.S. Pat. No. 6,093,498; and U.S. Pat. No. 6,193,854.

Although the Special Materials described in the aforementioned patents (for example as pyrophoric materials, foils, elements, etc.) are suitable for use in the decoys of the present invention, other Special Materials may also be suitable for use in the decoys of the present invention. Accordingly, the Special Materials of the present invention should not be limited to the Special Materials of the aforementioned patents.

As is known in the art, military aircraft are typically provided with decoys which are used to draw various types of guided weapons away from the aircraft. One of the most commonly used decoy devices are flares which are adapted to attract infra-red or heat seeking guided missiles away from the deploying aircraft (i.e., the target). In this respect, the flare is designed to present a more attractive thermal target than the aircraft from which it is deployed, thus decoying the weapon away from the aircraft.

In recent years, anti-aircraft weaponry has become more sophisticated, with enhanced capabilities to discriminate between flares and the deploying aircraft. The present invention offers improved dispensing methods which allow decoys to provide increased protection against these advanced threats.

BRIEF SUMMARY OF THE INVENTION

The present invention relates to decoys for heat-seeking missiles and methods of producing and using the same. The decays are designed, to be kinematic or pseudo-kinematic, producing one or more infra-red radiation emitting clouds that give the appearance of a moving infra-red target in the airspace in which the decoy has been released.

In one embodiment of the present invention, the decoy is composed of two or more bundles of pyrophoric elements that separate from one another in a sequential manner after the decoy is released from the target. As each bundle separates from the rest of the bundles, it creates an infra-red radiation emitting cloud that confuses or attracts a missile that is seeking a source of infra-red radiation. The sequential bundle release creates the appearance of a moving infra-red target. The mass of pyrophoric elements and/or the number of pyrophoric elements in each bundle may be varied to maximize the effectiveness of the decoy.

The two or more bundles of pyrophoric elements may be held together by any suitable means that permits or causes the bundles to separate from one another in a sequential manner. For example, the bundles can be held within a container, such as a can or tube, that permits or causes the bundles to be released from the can in a sequential manner. Alternatively, the bundles can be connected to a body which releases the bundles in a sequential manner after the bundles and body have been released from the target.

The method of release of the individual handles from the larger group of bundles is not critical as long as the bundles are released in a sequential manner alter the larger group of bundles has been released from the target.

Each bundle contains a plurality of pyrophoric elements that emit most of their infra-red radiation after the bundle is separated from the remaining bundles. In one embodiment of the present invention, the pyrophoric elements are foils or wafers that are self-igniting in air. The self-igniting foils or wafers can be made of a pyrophoric material or they can comprise a pyrophoric coating on a supporting body (e.g., a foil or web that can be composed of any material that can hold or bear the pyrophoric coating—for example, metal, cloth or paper) and are sometimes referred to herein as "Special Material" "Special Materials" or "SM". In another embodiment of the present invention, where the pyrophoric elements comprise a pyrophoric coating on a supporting body, the pyrophoric coating contains at least one pyrophoric powder and a binder and the pyrophoric elements are formed by applying a dispersion containing the pyrophoric powder, the binder and a solvent or carrier to at least a portion of the surface of a supporting foil or web in a nitrogen, reducing or inert atmosphere and then removing at least a portion of the solvent or carrier to form a pyrophoric body. In yet another embodiment of the press at invention, where the pyrophoric elements comprise a pyrophoric coating on a supporting body, the pyrophoric coating contains at least one pyrophoric powder, at least one ignitable powder and a binder and the pyrophoric elements are formed by applying a dispersion containing the pyrophoric powder, the ignitable powder, the binder and a solvent or carrier to at least a portion of the surface of a supporting foil or web in a nitrogen, reducing or inert atmosphere and then removing at least a portion of the solvent or carrier to form a pyrophoric body.

Depending on the size of the pyrophoric body that is produced by any of the processes known in the art, the body can be used as a pyrophoric element as is or it may need to be cut or chopped into smaller pieces, each of which is then a pyrophoric element.

Upon exposure to air, the pyrophoric elements produce infra-red radiation which can be used to attract infra-red seeking devices away from other infra-red emitting sources such as aircraft (including helicopters), ships and ground vehicles (i.e., targets).

DETAILED DESCRIPTION OF THE INVENTION

Figure 1:
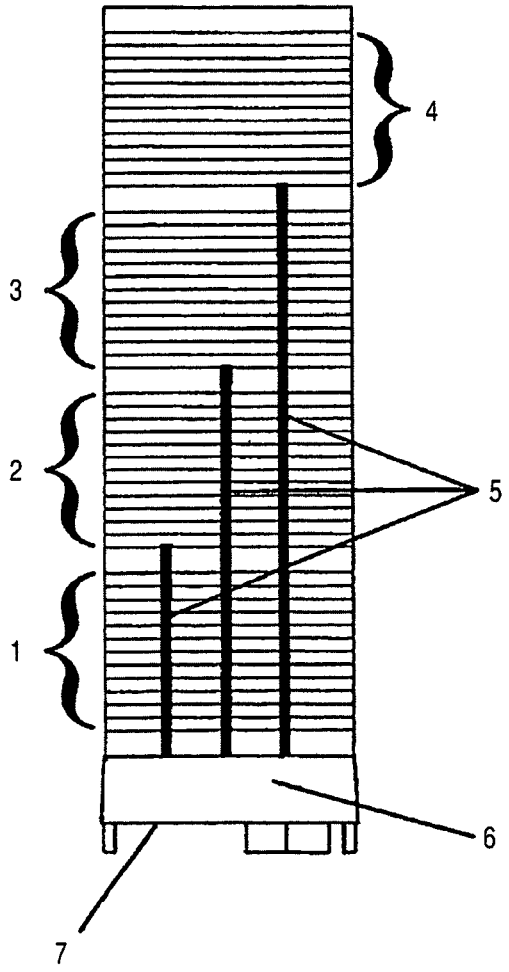
FIG. 1 is a side view of a preferred embodiment of the present invention showing a decoy having four bundles of Special Material (SM), three of which are strapped to an anchoring body (piston).

The present invention relates to decoys for heat-seeking missiles and methods of producing and using the same. The decoys are designed to be kinematic or pseudo-kinematic, producing one or more infra-red radiation emitting clouds that give the appearance of a moving infra-red target in the airspace in which the decoy has been released.

In one embodiment of the present invention, the decoy comprises a plurality of bodies (e.g., bundles of pyrophoric elements) that emit infra-red radiation after being activated and the decoy releases portions of the plurality of bodies sequentially. The bodies are activated either at the time of release or after release to the remainder of the decoy so that the released bodies emit infra-red radiation. In this way, the release of multiple bodies that emit infra-red radiation in a sequential manner as the decoy travels through the air creates an infra-red pattern or signature that appears as a moving target.

Although the decoys of the present invention can be adapted and/or modified to protect a variety of targets, such as ground vehicles (e.g., trucks, transports, tanks), water vehicles (e.g., ships and hovercraft) and aircraft (e.g., airplanes and helicopters), an especially preferred embodiment of the present invention is designed to protect aircraft in flight. In this embodiment of the present invention, the decoy is released from a flying aircraft and, for a certain period of time, the decoy travels in the same direction as the aircraft (due to: (a) the momentum that the decoy has; or (b) propulsive forces generated in the release of the decoy from the aircraft; or (c) propulsive forces from an engine or motor contained on the decoy itself—such as a small jet engine or rocket motor; or any combination of (a) to (c)). As the decoy travels in the same direction as the aircraft that released it, the decoy sequentially releases its payload of bodies that emit infra-red radiation, thus creating an infra-red source or pattern that appears to be moving in the same direction as the aircraft.

In a preferred embodiment of the present invention, the decoy comprises two or more bundles of Special Material (pyrophoric elements) and each bundle breaks apart after release from the decoy and forms a cloud of the pyrophoric elements that emits infra-red radiation (i.e., the cloud of pyrophoric elements heats up and creates a cloud that is emitting infra-red radiation). The two or more bundles are released sequentially from the decoy after the decoy has been released from the target aircraft. The Special Material elements are thin bodies of pyrophoric elements that have a high surface area to weight ratio and, accordingly, a high amount of air resistance (high drag in moving air). For example, the Special Material can be in the form of thin foils or wafers that are either composed of or coated with a pyrophoric material that reacts with air and emits heat (infra-red radiation). Due to their high drag in moving air, the Special Material foils or wafers come to an abrupt stop (or at least decelerate rapidly) in the air almost immediately after each bundle is released from the decoy. Specifically, almost immediately after a bundle of the Special Materials is released from the decoy, the bundle is torn apart by the force of the moving air, creating a cloud of the individual pyrophoric elements that decelerates rapidly to form a slow-moving or stationary cloud that then begins to settle slowly towards the ground. While the elements are strapped in bundles to the decoy after deployment, they do not react appreciably with the surrounding air because they are pressed or packed together tightly. Once the individual elements are separated from the bundle, the surfaces of each element are exposed to the air and the pyrophoric material is free to react with the air to create heat. The time from the initial separation of the pyrophoric elements from the bundle until they reach peak temperature is known as the rise time. The rise time is variable, depending on the pyrophoric material used. A preferred rise time is from about 0.01 seconds to about 3 seconds. Another preferred rise time is from 0.05 seconds to 0.1 second. A highly preferred rise time is from 0.05 to 0.6 seconds.

The mass of pyrophoric elements and/or the number of pyrophoric elements in each bundle may be varied to maximize the effectiveness of the decoy for a specific platform. Further, the number of bundles of pyrophoric elements per decoy can be varied. Preferred embodiments of the present invention include decoys that contain two, three, four or five bundles, where each bundle contains from about 400 to 1,000 pyrophoric elements. It is also sometimes desirable (based on the heat signature of the target to be protected) to have 6, 7, 8, 9 or 10 or more bundles that are released more rapidly than the embodiments using a lesser number of bundles. This can create a series of infra-red radiation emitting clouds that are closer together with an almost continuous infra-red radiation profile that appears as a moving target that is constantly emitting infra-red radiation. The exact configuration or number of bundles is determined through modeling and simulation analyses performed for each target/threat combination or through experimentation.

Although most of the embodiments of the present invention use at least three total bundles (i.e., a first bundle that is released immediately and at least two bundles that are released sequentially after the first bundle is released), certain embodiments of the present invention can use only one or two total bundles. In the embodiment of the present invention that uses one bundle, there is no immediate release bundle. Instead, the single bundle is released from the decoy after a predetermined amount of time has passed since the decoy was released from the target. In this embodiment of the present invention, the decoy can also contain another source of infra-red radiation, such as streamers of pyrophoric material (discussed below and shown in FIG. 3), so that the decoy will create an additional infra-red radiation source that appears to be moving through the air. In the embodiment of the present invention where the decoy contains two bundles, at least one of the bundles is not released immediately from the decoy. This means that the decoy can contain: (1) one bundle that is released immediately from the decoy as soon as the decoy is released from, the target and a second bundle that is released from the decoy after a predetermined amount of time has passed since the decoy was released from the target; or (2) two bundles that are released sequentially from the decoy at predetermined times after the decoy is released from the target (no bundle is released immediately from the decoy).

In a preferred embodiment of the present invention, the decoy contains two or more bundles of Special Material that are anchored to the decoy as it is traveling through the air and the decoy contains a means of releasing the bundles at timed intervals. The means for releasing the bundles can be any means known in the art and includes physical means, mechanical means, electronic means and combinations thereof. One preferred physical means is a fuse that is ignited at the time the decoy is released from the aircraft (e.g., by a small explosive charge or squib that ejects the decoy from the aircraft) and, over a short period of time, burns through loops (anchor loops) that keep the bundles anchored to the decoy. The anchor loops are made of a material that will fail upon being exposed to the heat of the burning fuse (such as plastic, rope or cloth, loops). Because the fuse burns at a relatively constant or predictable speed, the bundles are released at controlled intervals as the ruse burns its way through the various anchor loops that are disposed along the path of the fuse.

FIG. 1 shows a preferred embodiment of the present invention which is a decoy that comprises four Special Material (SM) bundles (shown as 1, 2, 3 and 4 in FIG. 1), and an anchoring element or body 6, sometimes referred to herein as the "piston". One of the four SM bundles (shown as 4 in FIG. 3) is not anchored to the piston. This bundle is either not bound at all (i.e., the bundle is a loose group of pyrophoric elements located at the top of the decoy) or is loosely bound so that the bundle 4 will immediately or quickly break apart into the individual pyrophoric elements when the decoy is ejected from the target. Three of the four SM bundles (i.e., 1, 2 and 3) are anchored to the piston 6 by wire straps 5 (the straps are made of metal wire hare but they could be made of any material that is strong enough to hold the bundles in place during the construction and use of the decoy, such as plastic strapping or polymeric string or line, such as fishing line). Each of these three bundles is anchored to the piston by a different wire strap. One end of each wire strap is permanently attached to the piston while the other end of the wire strap, after passing over the bundle that it is anchoring to the piston, is attached to the piston by an anchor loop. Each wire strap is attached to the piston by a different anchor loop. When the anchor loop for a particular wire strap is broken (e.g., burned through by a fuse located on the piston), the bundle that was held by that wire strap is released from the decoy into the surrounding air. The bundle is quickly broken up by the force of the moving air to create a cloud of pyrophoric elements that emit infra-red radiation after a short rise time. The bundles are released from the piston sequentially, with the bundle that is furthest away from the piston (bundle 3) being the first bundle released from the piston, the middle bundle (bundle 2) released next and the bundle closest to the piston (bundle 1) being released last. This sequential release is achieved by the arrangement of the anchor loops on the fuse. Specifically, the fuse passes through each of the anchor loops and burns in the direction from the loop holding the bundle that is furthest from the piston towards the loop holding the bundle that is closest to the piston.

Figure 7:
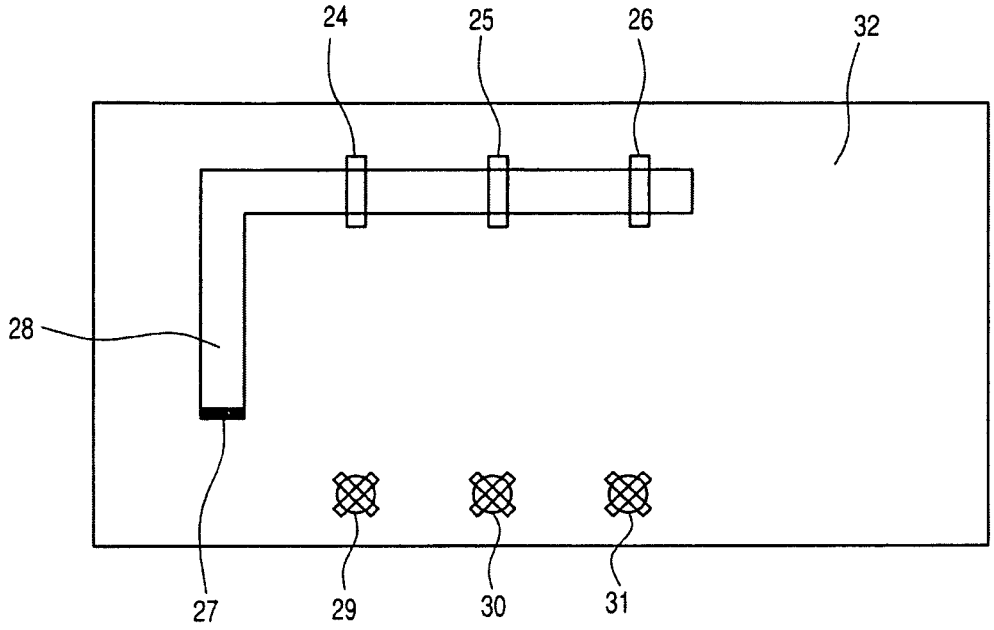
FIG. 7 shows one of the possible arrangements of the anchor loops on the fuse for the decoy embodiment shown in FIG. 1.

FIG. 7 shows one of the many possible configurations of the fuse, straps and anchor loops on the piston for the decoy of FIG. 1. The view in FIG. 7 is of the bottom surface of the piston 32 (location shown as 7 in FIG. 1). In FIG. 7, fuse 28 is located on the bottom of the piston 32, which is the side of the piston that is not facing the lowermost SM bundle of the decoy. One end of the wire strap for each of the three strapped bundles in the decoy of FIG. 1 is permanently attached to the piston. For the uppermost strapped bundle (the first strapped bundle to be released from the piston, shown as 3 in FIG. 1), this end of the strap is shown as 29 in FIG. 7. For the middle strapped bundle (the second strapped bundle to be released from the piston, shown as 2 in FIG. 1), this end of the strap is shown as 30 in FIG. 7 and for the lowermost strapped bundle (the last strapped bundle to be released from the piston, shown as 1 in FIG. 1), this end of the strap is shown as 31 in FIG. 7.

The other end of the wire straps for the decoy shown in FIG. 1 is attached to the piston by anchor loops, which are shown as 24, 25 and 26 in FIG. 7. These anchor loops pass over the fuse 28 and through the piston, attaching to the other end of the wire straps on the upper side of the piston. The anchor loops are made of a material that will be burned through or melted by the fuse as it burns past them. The position of the attachment of the other end of the wire straps to the anchor loops is not critical, as long as when the anchor loops fail, the wire strap is released and is free to move upward so that the bundle that is held in place by that wire strap is released from the piston. Accordingly, the wire straps themselves could pass through the piston and attach to the anchor loops on the bottom side of the piston. The anchor loops must be strong enough to hold the wire strap under tension until the time of release. This means that the anchor loops must be either attached to the piston itself or they must pass through the piston and attach to themselves, or to some other body, on the opposite side of the piston.

In the embodiment shown in FIG. 7, when the end 27 of fuse 28 is lit, the fuse burns in a direction towards the anchor loops 24, 25 and 26. The burning fuse reaches anchor loop 24 first and burns through or melts that anchor loop, causing the release of the uppermost strapped bundle from the piston 32.

A short time later, the burning fuse reaches anchor loop 25, and shortly thereafter anchor loop 26, causing the sequential release of the middle strapped bundle and then the lowermost strapped bundle from the piston 32.

In practice, the fuse can be located on either the bottom side of the piston, facing the bottom of the container that holds the bundles before they are deployed or released from the target, or on the top side of the piston, facing the bottom of the lowermost bundle. However, if the fuse is to be ignited by the detonation of a small explosive charge or squib located at the bottom of the container, then at least a portion of the fuse should be located on the side of the piston facing the squib (i.e., the bottom side of the piston). When the main body of the fuse is located on the side of the piston that is facing the squib, it is desirable to protect the main body of the fuse from, the hot gases that are released by the detonation of the squib. If this protection is not provided, it is possible that the fuse will ignite in several locations at once and this can result in a premature release of some or all of the bundles. The main body of the fuse can be protected, for example, by coating it with a fireproofing substance or by shielding it with a spacing element that sits between the squib and the base and protects the main body of the fuse (i.e., the portion of the fuse that passes through the anchor loops). In this embodiment of the present invention, die end of the fuse that is to be ignited is left exposed so that it can be ignited by the detonation of the squib.

In the decoy shown, in FIG. 1, there is also a group of loose pyrophoric elements that is located on top of the three strapped SM bundles (shown as 4 in FIG. 1). This group or unstrapped bundle of pyrophoric elements is not anchored to the piston and is released from the decoy immediately (i.e., as soon as the decoy is deployed from the aircraft). Thus, this group of loose pyrophoric elements creates an initial infra-red emitting cloud which serves to capture the attention of the attacking missile and is then followed sequentially by the three infra-red emitting clouds created by each of the strapped bundles after it is released from the piston (i.e., the clouds created shortly after each bundle is released from the piston).

In the embodiments of the present invention discussed above, one end of the straps that bind the bundles to the anchoring element or body (i.e., the piston) were connected to the piston by anchor loops. Each anchor loop is designed to release the end of the strap that is connected to it when the anchor loop is burned through or melted by a burning fuse. These anchor loops are just one example of the devices that can be used in the decoys of the present invention to bind the bundles to the anchoring element or body. As used hereinafter, the terms "fastener" and "fasteners" should be understood as referring to any device that connects at least one end of the binding straps to the anchoring element or body. Although the aforementioned anchor loops are one example of such fasteners, they are not the only fastener chat can be used in the decoys of the present invention.

In certain embodiments of the present invention, a fastener is not used to connect the binding straps to the anchoring body. In some of these embodiments, both ends of the binding straps are attached directly to the anchoring element or the binding strap passes around the anchoring element and is connected to itself (as a continuous loop). In these embodiments of the present invention, the binding strap itself is cut, burned through or melted by the timing means. For example, one or both ends of the binding strap can be in contact with or located near a fuse that burns through or melts the binding strap after the decoy has been released from the target. Similarly, when the binding strap is a continuous loop that passes over the anchoring element, a portion of the binding strap can be located next to or in contact with a fuse that burns through or melts the binding strap after the decoy has been released from the target.

Before deployment, the decoy of the present invention is held within a container that protects the pyrophoric elements from air. The container can be any container that can be hermetically sealed and will permit the decoy to be ejected from the container with a minimum amount of force. Usually, the atmosphere within the container is either withdrawn (no air) or modified so as to be non-reactive with the Special Material (e.g., a nitrogen or noble gas atmosphere). The force used to eject the decoy is usually created by expanding gases from a small explosive charge (sometimes referred to herein as a "squib") that is detonated (e.g., electrically or physically) in the container below the piston. These expanding gases build up pressure within the container until the end of the container that is furthest from the piston ruptures, allowing the decoy to be ejected from the container and out of the aircraft. Although this is the preferred method of ejecting the decoy from the container, one skilled in the art can immediately envisage many other ways of achieving this end result, including spring ejection means, hydraulic ejection means, etc. The specific manner in which the decoy is ejected from the container is not important as long as the decoy is ejected with sufficient force so that it successfully exits the aircraft and travels to a safe and/or desirable distance from the aircraft before creating the first infra-red radiation emitting cloud. The safe and/or desirable distance from the aircraft varies depending on the type of aircraft and the threat that is being decoyed.

Figure 2:
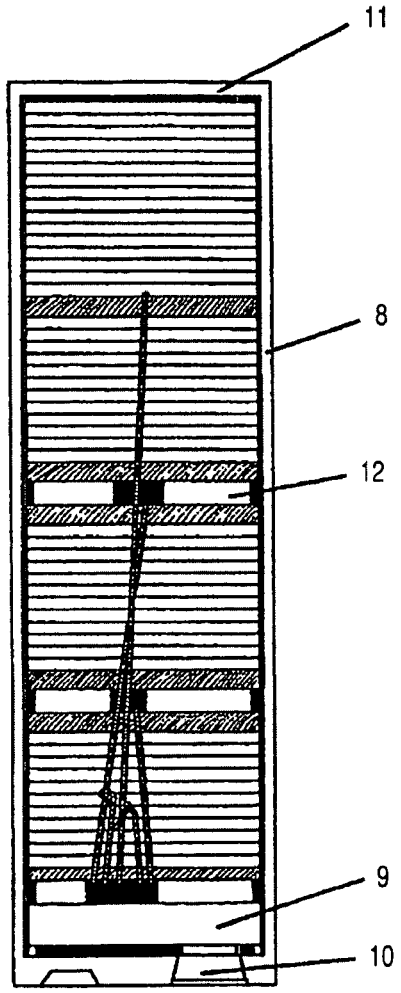
FIG. 2 is a cut-away view of a decoy that is contained in a metal can and is ready to deploy.

FIG. 2 shows a cut-away view of the decoy of FIG. 1 held within a metal container, shown as 8 in the figure. The cap 11 on the container is hermetically sealed and is designed to break out when the internal pressure reaches a high enough level to eject the decoy with sufficient force to clear the aircraft as discussed above. The metal container is designed to accept a small explosive charge or squib 10 that is positioned at the bottom of the container opposite the piston 9. In the present embodiment of the invention, wherein a fuse is used as the means for releasing the bundles, one end of the fuse is located on the side of the piston directly opposite the squib 10. In use, when the squib is detonated, the expanding hot squib gases break out a cap or disk that separates the squib from the interior of the scaled container. The hot squib gases then enter the space between the bottom of the container and the piston, filling that space (below the piston) with expanding gases that push upwards on the piston. The piston then moves up the container and compresses the SM payload (i.e., the bundles and any loose SM elements) against the end cap of the container until the end cap breaks out and the decoy is expelled front the container. The detonation of the squib also ignites the fuse and begins the process by which the strapped bundles are released from the anchor loops which hold them to the piston.

The combination of the container and the decoy can be referred to as a countermeasure. Thus, one embodiment of the present invention is a countermeasure for an infra-red radiation seeking device comprising, before deployment from a target: (a) a container; and (b) a decoy, wherein said decoy comprises: (i) two or more handles of pyrophoric elements; (ii) an anchoring body to which at least one of the two or more bundles of pyrophoric elements is releasably attached; and (iii) a means for sequentially releasing at least one bundle that is attached to the anchoring body; wherein said decoy is disposed in said container and said container is hermetically sealed, filled with a gas that is inert to said pyrophoric elements, or both.

The shape and size of each pyrophoric element in the bundle is not critical as long as the individual elements separate rapidly from one another as soon as the bundle which contains the elements is unstrapped. As a practical matter, the shape and size of the elements is limited by the internal dimensions of the container that houses or contains the bundles). It is preferred that the individual elements be thin foil or wafer bodies that have a high drag in moving air. Preferred cross-sectional geometries or shapes of the elements are rectangles, squares and circles. Preferred sizes and shapes of the elements are rectangles and squares with sides ranging from 0.5 inch to 4 inches and circles having diameters of from 0.5 inch to three inches. In a highly preferred embodiment, the elements are either one inch by two inch rectangles, one inch by one inch squares or circles with a diameter of 1.25 inch.

The preferred thickness of the pyrophoric elements is dependent on the Special Material performance characteristics required for a specific platform and the type of Special Material used. Generally, the pyrophoric elements have a thickness in the range from about 0.0005 inches to 0.03 inches (i.e., from about 0.0127 mm to 0.762 mm). However, these thicknesses can be varied substantially depending, for example, on the density of the Special Material used and the surface area of each pyrophoric element in the bundle. Accordingly, the thicknesses provided above are for illustrative purposes only and should not be used to limit the scope of the present invention.

When the cross-section of the bundle(s) in a decoy of the present invention has a rectangular geometry, the shorter side of the rectangle is usually from 0.5 inch to 2 inches (preferably from 0.5 inch to 1 inch), and the longer side of the rectangle is usually from 1 inch to 4 inches (preferably from 1 inch to 3 inches). When the cross-section of the bundle(s) in a decoy of the present invention has a square geometry, the sides of the square are usually from 0.5 inch to 4 inches, preferably from 0.5 inch to 3 inches or from 0.5 inch to 2 inches. When, the cross-section of the bundle(s) in a decoy of the present invention has a circular geometry, the diameter of the circle is usually from 0.5 to 3 inches, preferably from 0.5 to 2 inches.

The length of each bundle is dependent on the number of pyrophoric elements that are contained in the bundle. Typically, the bundles will have a length of front 0.5 inch to 5 inches, with a preferred length being from 0.5 inch to 3.5 inches. In certain embodiments of the present invention, it may be useful to use smaller bundles and in those embodiments, the length of the bundle may be from 0.3 inch to 2.5 inches.

In one embodiment of the present invention, the bundles inside the decoy contain the same kind of pyrophoric element (i.e., all of the pyrophoric elements are made of the same material). In another embodiment of the present invention, each bundle inside the decoy is composed of pyrophoric elements made from the same type of pyrophoric material, but the elements in at least one of the bundles are made from a different material than the elements in another bundle in the same decoy. In another embodiment of the present invention, the pyrophoric elements in each bundle of the decoy are made from the same material but no two of the bundles contain elements made from the same material (i.e., each bundle is composed of pyrophoric elements that are made from a different material than the elements of any of the other bundles in the same decoy). In yet another embodiment of the present invention, one or more of the bundles in the decoy contain pyrophoric elements that are not made of the same material as the other elements in the same bundle (i.e., one or more of the bundles in the decoy contains a mixture of pyrophoric elements that are made from different materials). Varying the Special Material type in different bundles within the same decoy device allows even greater flexibility to tailor the infra-red output to meet the requirements of specific platforms while minimizing the number of decoys deployed.

Through use of the decoys of the present invention, it is possible to protect slow moving aircraft or even hovering aircraft (such as helicopters, hovering jets and tilt-rotor airplanes). This is possible when the ejection speed of the decoys is sufficient to permit the bundles to break apart into their individual elements as the bundles are released. The hot clouds that form as the bundles break apart appear to be moving through the air as the decoy moves or flies away from the aircraft and the infra-red seeking missile follows the decoy away from the slow-moving or hovering aircraft.

In one embodiment of the present invention, the bundles in the decoy are connected to one another by interlocking members. The interlocking members allow the individual bundles to be quickly and easily connected to one another while, at the same time, allowing the bundles to be separated from one another after the decoy has been released from the target. For example, the interlocking members can be snap-fit devices that are connected to the top of one bundle (i.e., bundle A) and the bottom of the bundle that is disposed directly above bundle A (i.e., bundle B). Bundle A and bundle B are brought together and connected by applying pressure to the bundles so that the male portion of the snap-fit device mates with and connects to the female portion of the snap-fit device. In a similar fashion, the snap-fit device can be replaced by interlocking ridges and grooves that mate together (for example when force is applied perpendicularly or horizontally to the ends of the bundles that have the ridges and grooves) to connect the two bundles. The interlocking members provide additional side to side stability to the stack of bundles as they are disposed within the container. Strapping means are also used to bind each bundle to the piston in the container. When the straps are released while the decoy is in flight, the interlocking members fail under the wind pressure and allow the bundles to separate from one another.

Figure 3:
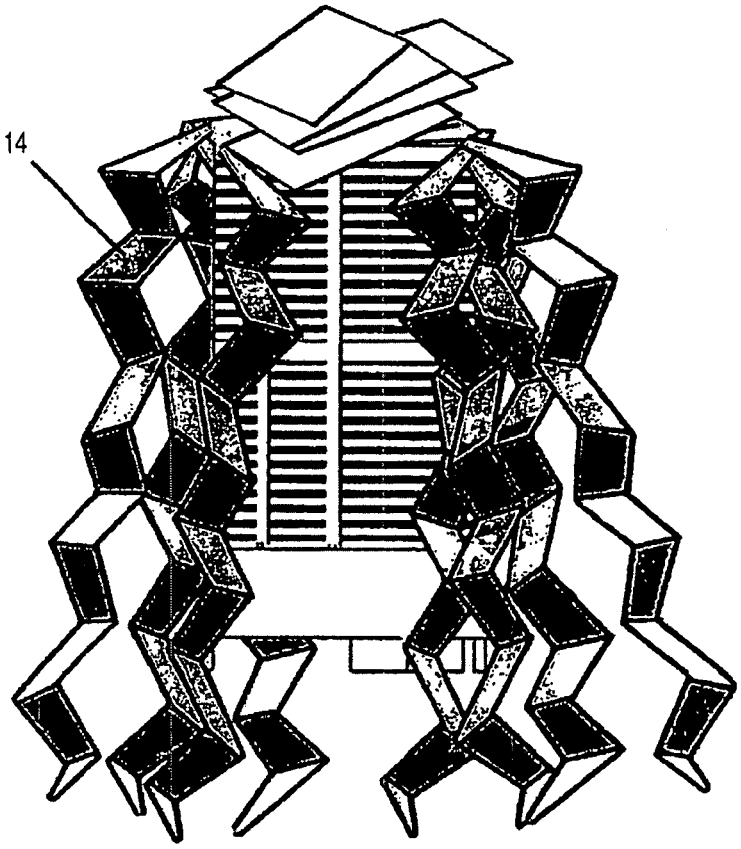
FIG. 3 shows another embodiment of the present invention in flight (after deployment or release). In this embodiment, the decoy contains folded ribbons of Special Material in addition to the strapped bundles, and the ribbons unfold in flight and emit infra-red radiation as the decoy flies through the air. The ribbons are thus towed by the strapped handle below them and further enhance the kinematic output of the decoy.

FIG. 3 shows an embodiment of the present invention wherein ribbons of Special Material (shown as 14 in FIG. 3) are included in the decoy. The purpose of the ribbons is to provide a source of infra-red radiation in between the releases of the individual handles while the main body of the decoy is flying through the air. In a preferred embodiment, separate groups of these ribbons are attached to a plate that is the top piece of each strapped bundle. The ribbons are folded into compact bodies while inside the container and are restricted by the wire straps that anchor the bundles to the piston. Once the decoy is deployed, the uppermost group of ribbons unfold in the air stream and heat up, creating an infra-red radiation source as the decoy flies through the air. Once the bundle to which the ribbons are attached is released, that group of ribbons flies off with the separated bundle and a new group of ribbons is exposed to the air stream. The ribbons provide a true kinematic component to the decoy, because they are emitting infra-red radiation as the decoy flies along its trajectory and in between the time when the bundles are released from the decoy. The mass of ribbons and the number of ribbons can be varied to maximize effectiveness. Also the ribbons can be made of a SM that is different than the SM elements in the bundles. This can provide a varied infra-red profile or signature to the decoy which can increase its effectiveness against certain threats.

In another embodiment of the present invention, a Special Material powder can be added to the decoy to create a different infra-red signature or pattern. Specifically, since Special Material powder has a shorter rise time than the foil or wafer type of pyrophoric element, the combination of Special Material powder with the pyrophoric elements can provide a pyrophoric cloud with a faster rise time (i.e., the rise time is decreased). One way of including the Special Material powder with the pyrophoric elements in the decoys of the present invention is to create holes in the pyrophoric elements and then fill the holes with the Special Material powder. For example, each of the bundles of pyrophoric elements can have one or more holes that pass part or all of the way through the bundle and those holes can be partially or completely filled with Special Material powder. When the bundle is released from the piston, the cloud that forms is composed of both the foil or wafer pyrophoric elements, which take a short amount of time to heat up to peak temperature, and the Special Material powder, which heats up to peak temperature faster. Thus, this type of cloud emits infra-red radiation sooner and longer than the cloud that is composed of only the foil or wafer elements. However, this type of cloud is not always advantageous because the overall infra-red signature or pattern per unit mass of Special Material in the bundle will be different and may not be appropriate or desirable for certain threats (i.e., the cloud may never reach a high enough temperature or the size of the cloud may be reduced).

Another way of including the Special Material powder with the pyrophoric elements in the decoys of the present invention is to include the powder in a small container that sits atop a portion of each strapped bundle of pyrophoric elements and is held in place by the strap for that bundle. In use, the container opens when the strap for that bundle is released.

It is sometimes desirable to include spacers between the individual strapped bundles. Such spacers were used in the decoy shown in FIG. 2 and a representative spacer is labeled as 12 in FIG. 2. The spacers, when used, can be any material (e.g., plastic, cork or metal) that does not adversely react with the other materials in the decoy. If the decoy is to be ejected by means of hot gases, the spacers should be made of a material that will not melt appreciably during the ejection process. It is also sometimes desirable to use a metal plate as the uppermost and/or lowermost part of each strapped bundle. The metal plate(s) add support to the bundles and help to protect the pyrophoric elements from being damaged by the straps (especially when metal wire straps are used). They also can help to contain any Special Material powder that has been added to any holes that may be in the bundles of pyrophoric elements. These plates can be made of materials other than metal but should not be made of materials that will react with the Special Material or be damaged during the ejection process.

Figure 4:
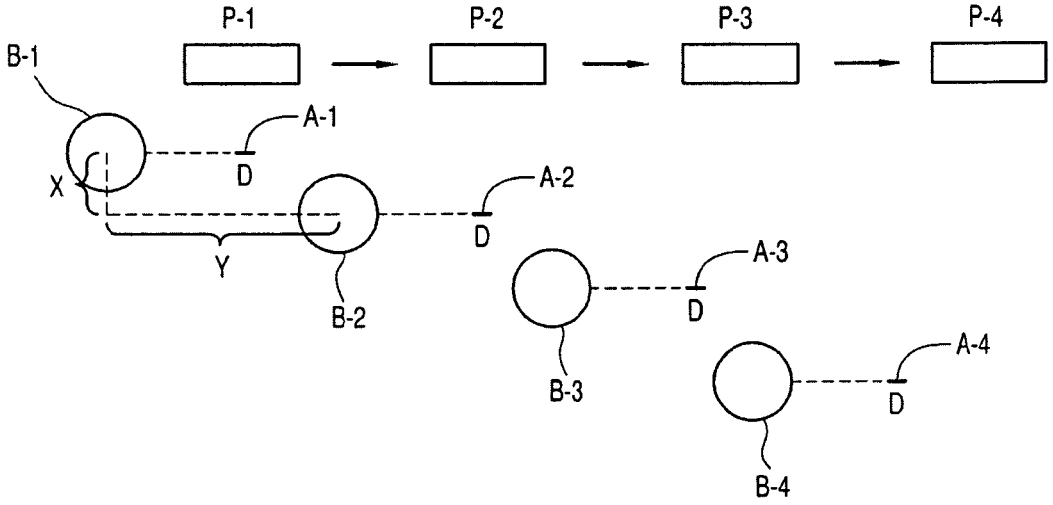
FIG. 4 shows a profile of the release points for the bundles of the decoy shown in FIGS. 1 and 2 and the approximate points (relative to the target airplane) at which the pyrophoric clouds created by the released bundles reach maximum or peak temperature.

FIG. 4 shows an estimated profile of the horizontal and vertical positions (relative to the moving aircraft) at which the decoy of FIG. 1 will release the bundles of Special Material (A-1 to A-4) and positions at which the pyrophoric clouds will form from those released bundles (B-1 to B-4). For the purposes of this discussion and the figure, the unstrapped group of pyrophoric elements that is positioned at the end of the container that is farthest from the piston (i.e., the group of pyrophoric elements that is released immediately from the decoy when it is deployed) is treated as a "bundle" and is shown as A-1. In FIG. 4, the aircraft is shown in four different positions, P-1 to P-4. Position P-1 is the position of the aircraft just after it has released the decoy D. As shown in the figure, bundle A-1 is released immediately from the decoy and forms a cloud B-1 of pyrophoric elements that emits infra-red radiation. Bundle A-2 is released shortly thereafter as the decoy flies along through the air at approximately the same speed as the aircraft and it forms a cloud B-2 of pyrophoric elements that emits infra-red radiation. Since the decoy is traveling in the same direction as the plane but is also falling towards the ground as if travels through the air, the cloud B-2 appears at a position that is ahead of (i.e., in the direction that the plane is traveling) and slightly lower than the position of cloud A-1. This pattern continues with bundles A-3 and A-4 and the clouds B-3 and B-4 of pyrophoric elements that they form (each cloud is a little further ahead of and lower than the previous cloud). Further, in the embodiment shown in FIG. 4, the decoy does not have its own means of propulsion. This means that as soon as the decoy is released from the aircraft, its forward velocity starts to decrease while its velocity towards the ground starts to increase. The net effect of these changes in the velocity of the decoy is that the horizontal distance X between the clouds decreases as each new cloud is formed while the vertical distance Y between the clouds increases.

It is possible to modify the rate of change of the velocity (i.e., the forward velocity, the velocity towards the ground or both) of the decoy after it is released from the aircraft by changing the structure of the decoy or by providing the decoy with a means of propulsion. It is also possible to modify the direction that the decoy flies once it is released from the aircraft. For example, the decoy can be made to fly in the same direction as the aircraft or the decoy can be designed so that it slowly turns to the left or right as it flies (e.g., by designing the decoy so that one side of the decoy has a higher drag in the air than the other side). Since the flight path of the decoy dictates the positions of the clouds B-1 to B-4 in relation to the aircraft that released the decoy, a large number of possible cloud patterns are possible. This flexibility allows the decoy of the present invention to be tailored to meet a wide variety of threats.

As shown in FIG. 4, the infra-fed signature or pattern that is created by the decoy of FIG. 1 appears to be an infra-red source that is moving in the same direction and at approximately the same speed as the target aircraft. This is a very desirable decoy that overcomes the problems associated with the current Special Material decoys that create a rapidly decelerating or stationary infra-red emitting cloud from a single release of Special Material foils or wafers, while retaining the benefits of using Special Material to create the infra-red radiation source. These benefits include (but are not limited to): (1) more realistic infra-red signatures that are not rejected by the incoming threat as being too hot or too bright; (2) covert status (the clouds do not generate significant output in the visible spectrum), and (3) limited threat to personnel and property on the ground (the foils and/or powder are either completely consumed during the pyrophoric reaction or the remaining portions of the foils and/or powder settle gently to the ground in a cool state after use and the remaining parts of the decoy that fall to the ground after use are lightweight and not hot).

In the preferred embodiment of the present invention that is shown in FIGS. 1 and 2 of the present application, the size and/or mass of the Special Material payload in each bundle, the number of bundles and the timing of the release of the individual bundles can all be varied to maximize the decoy effectiveness for specific targets (e.g., target aircraft) against a variety of threats.

Figure 5:
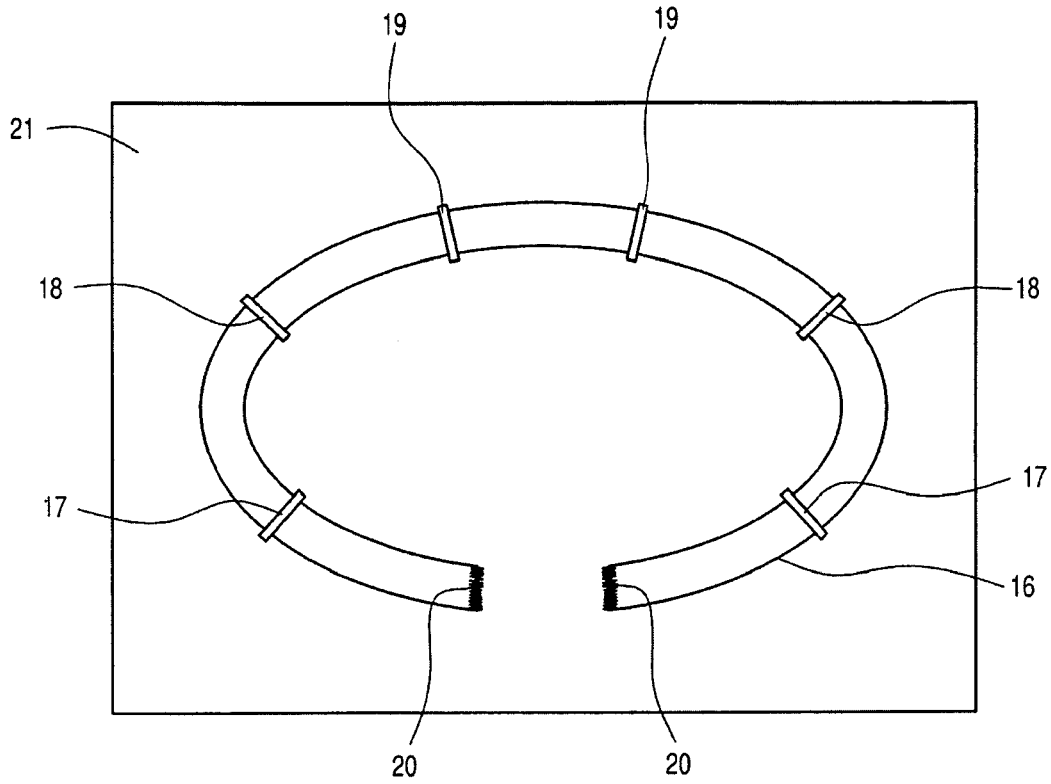
FIG. 5 shows the arrangement of the anchor loops on the fuse for an alternative embodiment of the present invention.

In a preferred embodiment of the present invention, that is shown in FIG. 5, a different type of fuse arrangement is used as the timing means for the release of the bundles from a decoy which otherwise has the same design as the decoy shown in FIGS. 1 and 7. Specifically, instead of having one end of each strap being permanently attached to the piston while the other end of the strap is attached to the piston by an anchor loop, which is the embodiment shown in FIG. 7, in the embodiment shown in FIG. 5, both, ends of each strap are attached to the piston 21 by anchor loops. The anchor loops for each strap are positioned on the fuse (shown as 16 in FIG. 5) so that regardless of which end of the fuse is ignited first, one of the two anchor loops for each strap will be burned through or melted in the correct sequential order so that the bundles will be released, in the proper order. For example, in the decoy shown in FIG. 1, there are three bundles that are bound to the piston and one bundle (the fourth bundle up from the piston) that is to be released immediately. Of the three bundles that are bound to the piston, the first bundle that is to be released from the decoy is the third bundle up from the piston. In FIG. 5, the two ends of the strap for this bundle are attached to the two anchor loops shown as 17. The next bundle to be released front the piston is the second bundle up from the piston. In FIG. 5, the two ends of the strap for this bundle are attached to the two anchor loops shown as 18. The final bundle to be released from the piston is the first bundle up from the piston. In FIG. 5, the two ends of the strap for this bundle are attached to the two anchor loops shown as 19. As shown in FIG. 5, the anchor loops for each bundle are located at the same distance from the closest end of the fuse (each end of the fuse is shown as 20 in FIG. 5). This means that, regardless of which end of the fuse is ignited first, or even if both ends of the fuse are ignited simultaneously, the bundles will still be released in the proper order and at the proper times. In practice, if the fuse is to be ignited by the detonation of the squib, then the main part of the fuse may be protected from the hot gases that are released by the detonation of the squib as discussed earlier, for example by coating the main body of the fuse with a fireproofing substance or by shielding it with a spacing element that sits between the squib and the fuse. In this embodiment of the present invention, both ends of the fuse would be left exposed so that either end, or both ends, of the fuse could be ignited by the detonation of the squib. This embodiment of the present invention is preferred because it provides redundancy to ensure proper bundle release (e.g., even if one side of the fuse does not ignite, stops burning before it reaches an anchor loop, or one of the anchor loops is not fully burned through or melted by the fuse, the other side of the fuse still burns through or melts the other anchor loop for that bundle and thereby releases that bundle at the proper time).

Figure 6:
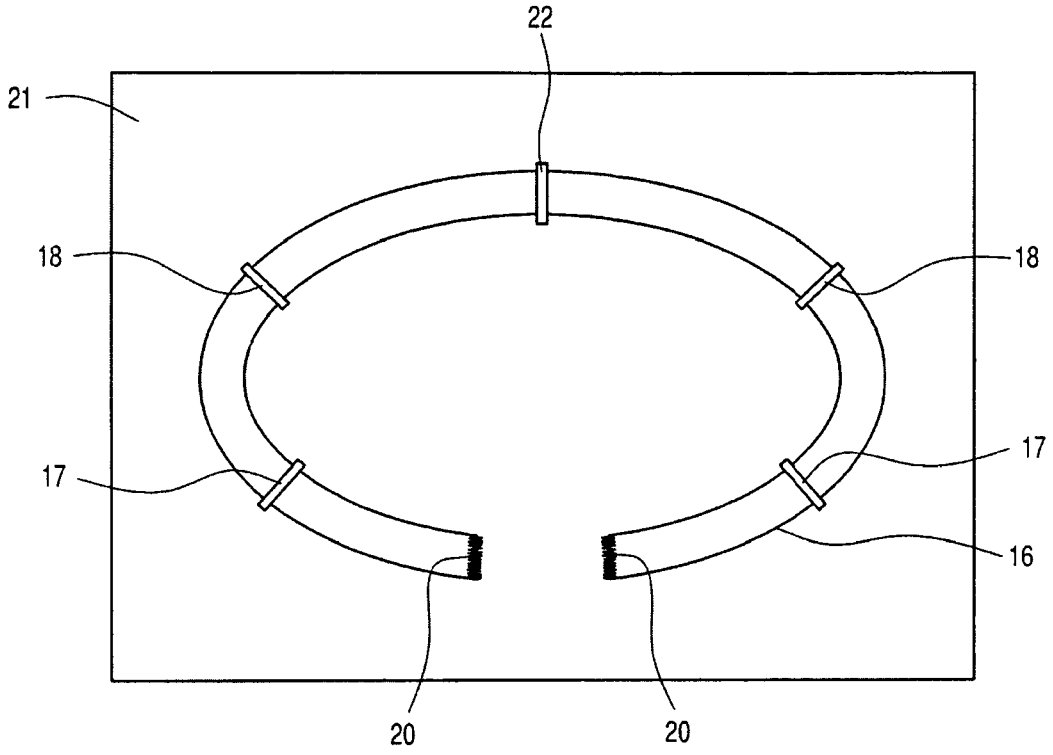
FIG. 6 shows the arrangement of the anchor loops on the fuse for a variation of the embodiment shown in FIG. 5.

In another embodiment of the present invention, which is shown in FIG. 6 and is very similar to the embodiment shown in FIG. 5 (as discussed above in the preceding paragraph), the final bundle to be released from the piston is bound to the piston by a strap which is attached to only one anchor loop (shown as 22 in FIG. 6). This anchor loop is located midway between the two ends of the fuse so that regardless of which end of the fuse is lit first, this anchor strap will always be burned through or melted at the same time. In this embodiment of the present invention, one end of the strap holding the final bundle to be released from the piston can be attached to the piston, if desired, or both ends of the strap can be attached to the anchor loop 22. In FIG. 6, all of the lead lines, other than 22, identifying various portions of the structure shown in the figure, use the same identifying numbers as FIG. 5 and those lead lines and numbers have the same meaning in FIG. 6 as in FIG. 5.

In some of the embodiments of the present invention, a fuse is used as the means for releasing the bundles from the decoy while the decoy is in flight (i.e., after the decoy has been released from the target it is intended to protect). Other means for sequentially releasing the bundles from the decoy include the means described below.

(1) Mechanical and/or electronic means that are designed to hold the bundles in place until a specified amount of time has passed, at which time a bundle is released from the decoy. In this embodiment, the mechanical and/or electronic means could release each bundle from the decoy at the same time interval (e.g., one second between, releases) or at various time intervals (e.g., first bundle at 0.5 second, second bundle at 1.25 seconds and third bundle at 2.5 seconds).

(2) Mechanical and/or electronic means that are triggered by altitude or velocity sensors that send signals to the mechanical and/or electronic means causing the release of the bundles in a sequential manner as the decoy reaches certain velocities or altitudes.

(3) Mechanical and/or electronic means that sense how far away from the target the decoy is and cause the release of the bundles in a sequential manner as the decoy reaches certain distances from the target to be protected. In this embodiment, the decoy could send electronic signals to, or receive electronic signals from, the target to be protected in order to determine the distance from the decoy to the target.

(4) Small amounts of pyrophoric material could be disposed on the top surface of each of the strapped bundles and in contact with (or located close to) the strap that binds the bundle to the piston. As the top of each bundle is exposed to the air while the decoy is in flight, this pyrophoric material would, heat up and melt or burn through the strap, thereby releasing the bundle. For the bundles that are strapped to the piston and have another bundle strapped on top of them, the pyrophoric material would be positioned in such a way that its access to air would be minimal while the bundles remain tightly strapped together and while all of the bundles are in the container. The pyrophoric material on the top of the uppermost strapped bundle would either have a cover that remains in place until the first (unstrapped) bundle is released, at which time the cover is removed or opened so that air can contact the pyrophoric material and cause it to melt or burn through the strap that binds the uppermost bundle to the piston, or the pyrophoric material on the top of the uppermost strapped bundle would be formulated so that it heats up at a slightly slower rate than the pyrophoric material on top of the other strapped bundles (or the strap for the uppermost bundle could be a little thicker or have a higher melting point than the straps holding the other strapped bundles). In any event, the straps for each of the strapped bundles would fail a short period of time after the top of the bundle was exposed to air.

(5) Each of the bundles could be individually disposed within a covering material that seals out air (or at least slows down the rate at which air can contact that bundle), such as plastic shrink wrap. A portion of the surface of the covering material would be coated or painted, with a pyrophoric slurry that remains on the surface of the covering material and, when exposed to air, will heat op and burn through the covering material, thereby releasing the bundle from the decoy. By using different covering materials (or different thicknesses of the same covering material) or different pyrophoric slurries, the covering materials on the various bundles can be made to fail in a sequential manner, thereby causing the release of the bundles in a sequential manner. In this embodiment of the present invention, the individually wrapped bundles can be connected to each other (e.g., by connecting the covering material on the outside of one bundle to the covering material on the outside of the next bundle in the decoy) or they can be connected separately to a central member (e.g., by connecting the covering material on each bundle to a rod or plate that remains with the covered bundles in flight after the decoy has been released). It is also possible to use one piece of covering material in which multiple bundles are separately contained (for example by placing the bundles on top of a single sheet of covering material with a space between each bundle and then folding the sheet over the bundles and forming a seal around each bundle).

(6) As an alternative to (5), the bundles could be sequentially covered with multiple layers of the covering material so that as each layer fails, a bundle is released from the decoy. For example, in this embodiment of the present invention, to create a decoy that has four total bundles, the fourth or uppermost of which is released immediately as soon as the decoy is released from the target, and the remaining three bundles are released sequentially after the decoy has been released from the target, the last of the bundles to be released, would be the first bundle to be covered with the covering material. A portion of the surface of the covering material on this first bundle would be covered with a pyrophoric slurry and then this first bundle would be joined with a second bundle (the second to last bundle to be released) by disposing a second covering material around both the second bundle and the first covered bundle. After covering a portion of the surface of the second covering material with a pyrophoric slurry, the combined first and second covered bundles would be joined with a third bundle (the second bundle to be released from the decoy) by disposing a third covering material around both the combined first and second bundles and the third bundle. A portion of the outer surface of the third covering material would be coated with a pyrophoric slurry before the three covered bundles ware disposed in the container with the fourth bundle, which remains uncovered. The fourth bundle is the first bundle that is released from the decoy and it is released immediately after the decoy is released from the target. After the fourth bundle is released, the remaining three bundles would fly through the air as the pyrophoric slurry on the outside of the third covering material heats up and causes the third covering material to fail, thereby releasing the third bundle. Once the third covering material fails, the pyrophoric slurry on the second covering material, which up until now had been protected from the air, is exposed to air and heats up causing the pyrophoric slurry to heat up and the second covering material to fell, thereby releasing the second bundle. Finally, once the second covering material falls, the pyrophoric slurry on the first covering material is exposed to air and heats up, causing the first covering material to fail and thereby releasing the first bundle.

In the above-described embodiments (5) and (6), the covering materials are designed to fail through the action of the pyrophoric slurry that heats up upon exposure to air and melts or burns through the covering material. The pyrophoric slurry can be replaced by a pyrophoric tape, string or wire that can be adhered to at least a portion of the covering material. Alternatively, any means that causes the covering material(s) to fail in a sequential manner could be employed in these embodiments of the invention.

(7) When the bundles are connected to a body, such as the piston described earlier, by straps, the straps can be connected to the body through fasteners that are exposed to small columns of pyrotechnic powder. The small columns of pyrotechnic powder that are in contact with each fastener can be made of the same pyrotechnic material but have different lengths so that when one end of all of the columns is ignited, the fasteners at the other end of the columns will be melted or burned through at different times. Alternatively, the columns can all be of the same length but composed of different materials so that they burn at different rates. The end result here will be the same in that the fasteners will be burned through or melted at different times, thus providing a sequential release of the strapped bundles.

(8) Each of the bundles, other than the bundle that is released immediately from the decoy, can be released from the other bundles to which it is connected by using small streamers or parachutes that are connected to the top of each bundle and are folded up prior to release of the decoy from the target. When the decoy is released from the target and the force of the air moving past the uppermost bundle causes the streamers or parachute(s) to deploy, the force of the moving air tugging on the streamers or parachute(s) breaks the means connecting that bundle to the next bundle in the series of bundles, thereby releasing that bundle from the remaining bundles. Upon release of the uppermost bundle in the series of connected bundles, the top of the next bundle is exposed to the force of the moving air which causes the streamers or parachute on that bundle to deploy, thereby breaking the means connecting that bundle to the renaming bundles. This process continues until all of the bundles are separated from one another. After each bundle separates from the remaining bundles, it must still release the pyrophoric elements contained in the bundle to form a cloud that will emit infra-red radiation. The release of the pyrophoric elements from each bundle can occur at the time the bundle is separated front the other bundles or shortly thereafter. If the release of the pyrophoric elements occurs at the same time as the release of the bundle from the other bundles, then the release can occur because the action of breaking the means that held the bundle to the remaining bundles is sufficient to also break the straps or other means that holds the bundle together, or as the bundle is released from the other bundles, some other means (such as a small explosive charge) causes the bundle to break apart. The pyrophoric elements of the bundle can be released after the bundle is released from the remaining bundles by using a small explosive charge or a pyrophoric body or mass that breaks, burns or melts the straps or other means that keep the pyrophoric elements together shortly after the bundle is released from the remaining bundles.

One advantage to using mechanical, electronic or pyrophoric means to release the bundles from the decoy (i.e., in comparison to a pyrotechnic means, such as a burning fuse) is that the decoy can be made so that it does not contain any explosive material. This can be important and advantageous in certain situations where explosive materials could be hazardous or unstable and can result in a decoy or countermeasure that has a less restrictive hazard class rating.

In one embodiment of the present invention, the anchoring element or body is not the piston but is a body that is disposed between the piston and the lowermost pyrophoric element of the lowermost strapped bundle. This body can be apart of the lowermost strapped bundle, such as a spacer or a metal plate, or it can be a distinct body that is separate from, and disposed between, the piston and the lowermost bundle of pyrophoric elements. In this embodiment of the present invention, if the means for releasing the bundles at timed intervals is a fuse, then a portion of the fuse can penetrate or otherwise pass-through the piston so that it can be ignited by the hot gases released by the small explosive charge or squib that ejects the decoy from the aircraft. Upon ejection from the aircraft, the piston fells away from the rest of the decoy and the burning fuse then causes the subsequent release of the strapped bundles in a sequential manner.

In another embodiment of the present invention, where the anchoring element or body is not the piston but is a body that is disposed between the piston and the lowermost pyrophoric element of the lowermost strapped bundle, the means for releasing the bundles at timed intervals are pyrophoric bodies that are located on the top (upper) surface of each strapped bundle and in contact with (or located close to) the one or more straps that bind the bundle to the anchoring element or body. As the top of each bundle is exposed to the air while the decoy is in flight, the pyrophoric body located on the top (upper) surface of the strapped bundle heats up and melts or burns through the one or more straps, thereby releasing the bundle. For the bundles that are strapped to the anchoring element or body and have another bundle strapped on top of them, the pyrophoric body would be positioned in such a way that its access to air would be minimal while the bundles remain tightly strapped together and while all of the bundles are in the container. The pyrophoric body on the top of the uppermost strapped bundle would either have a cover that remains in place until the first (unstrapped) bundle is released, at which time the cover is removed or opened so that air can contact the pyrophoric body and cause it to melt or burn through the one or more straps that bind the uppermost bundle to the piston, or the pyrophoric body on the top of the uppermost strapped bundle would be formulated so that it heats up at a slightly slower rate than the pyrophoric body on the top of the other strapped bundles (or the one or more straps for the uppermost bundle could be a little thicker or have a higher melting point than the straps holding the other strapped bundles). In any event, the one or more straps for each of the strapped bundles would break or fail a short period of time after the top of the bundle was exposed to air, thereby releasing that bundle and allowing the pyrophoric elements in that bundle to disperse into the air to form a cloud that emits infra-red radiation. In this embodiment of the present invention, the anchoring element or body can be a part of the lowermost strapped bundle, such as a spacer or a metal plate, or it can be a distinct body that is separate from, and disposed between, the piston and the lowermost bundle of pyrophoric elements. Each of the straps that holds the bundles together is either: (1) attached to this anchoring element or body; (2) in contact with this anchoring element or body; or (3) in contact with one or more spacers that are disposed between the strips and the anchoring element or body.

Figure 8:
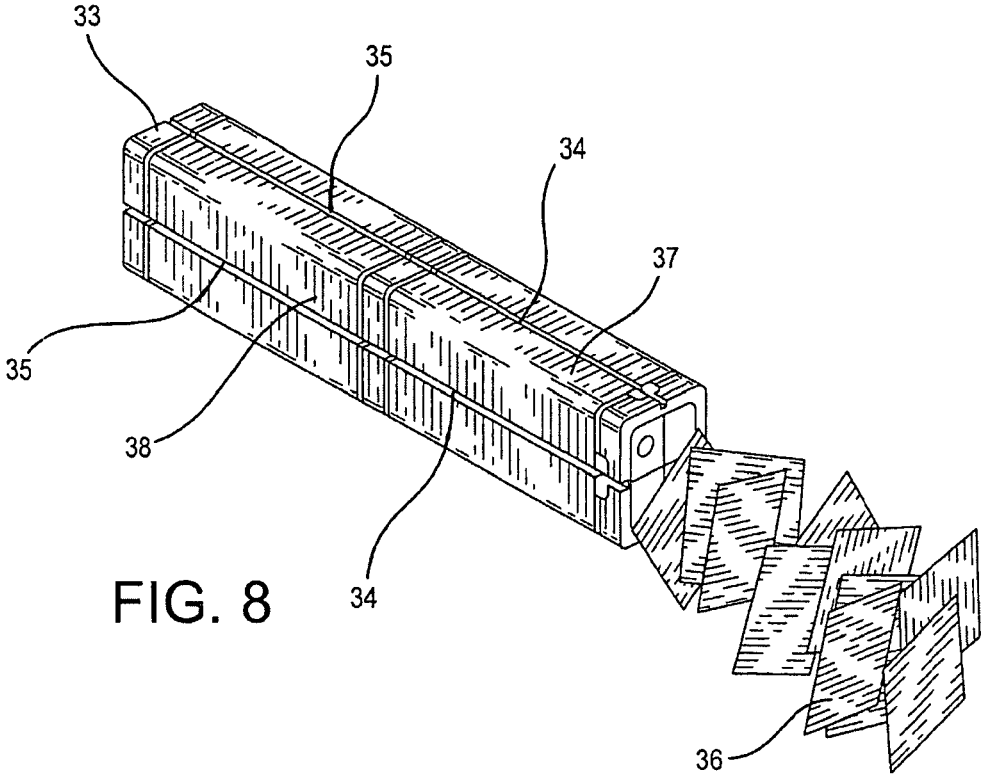
FIG. 8 is a side view of a preferred embodiment of the present invention showing a decoy having three bundles of Special Material (SM), two of which are strapped to an anchoring body (i.e., a base spacer in this embodiment of the invention). The uppermost bundle in this figure, which was a loose (i.e., non-strapped) bundle, is in the process of dispersing into the air (i.e., after deployment).
Figure 9:
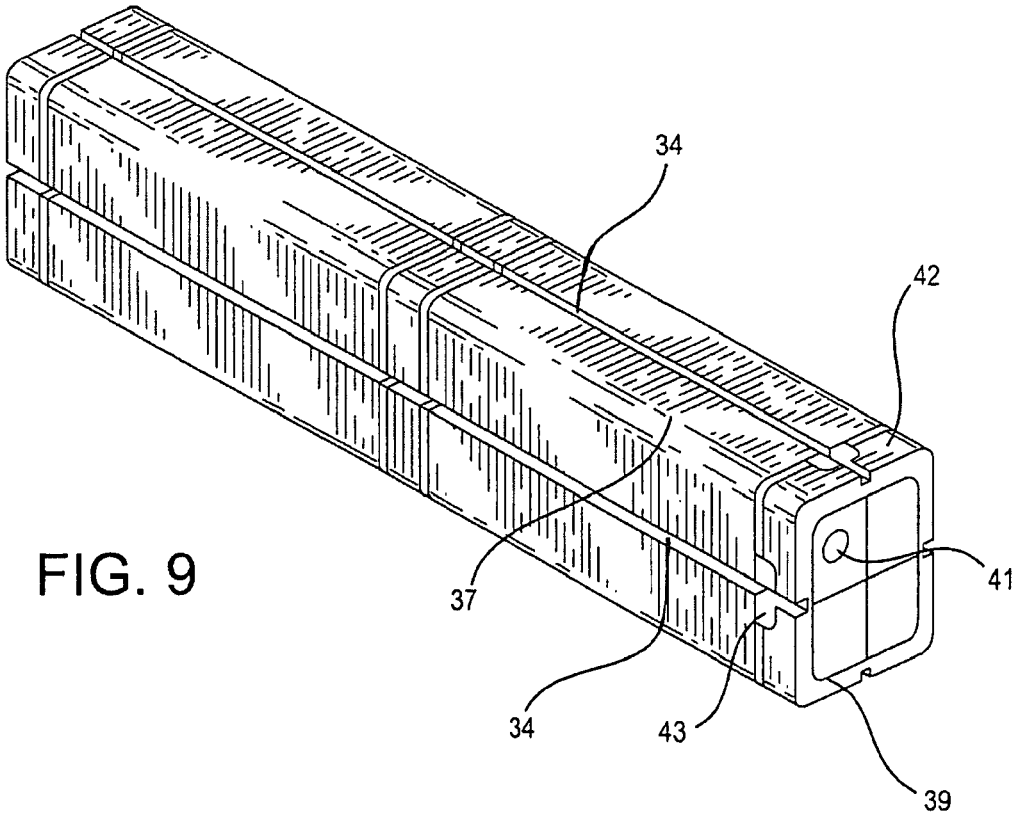
FIG. 9 is a side view of the decoy of FIG. 8, after the uppermost bundle has been released from the remaining bundles and has dispersed into the air but before the uppermost strapped bundle has been released from the remainder of the decoy.
Figure 10:
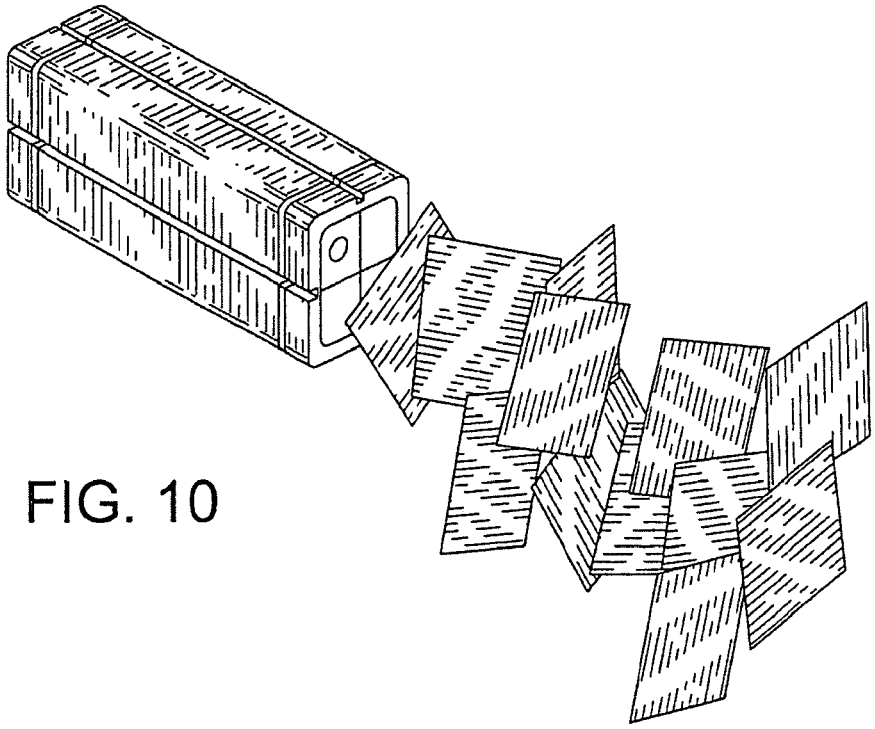
FIG. 10 is a side view of the decoy of FIG. 9, after the uppermost strapped bundle has been released from the remainder of the decoy. The uppermost strapped bundle in this figure is now unstrapped and is in the process of dispersing into the air.
Figure 11:
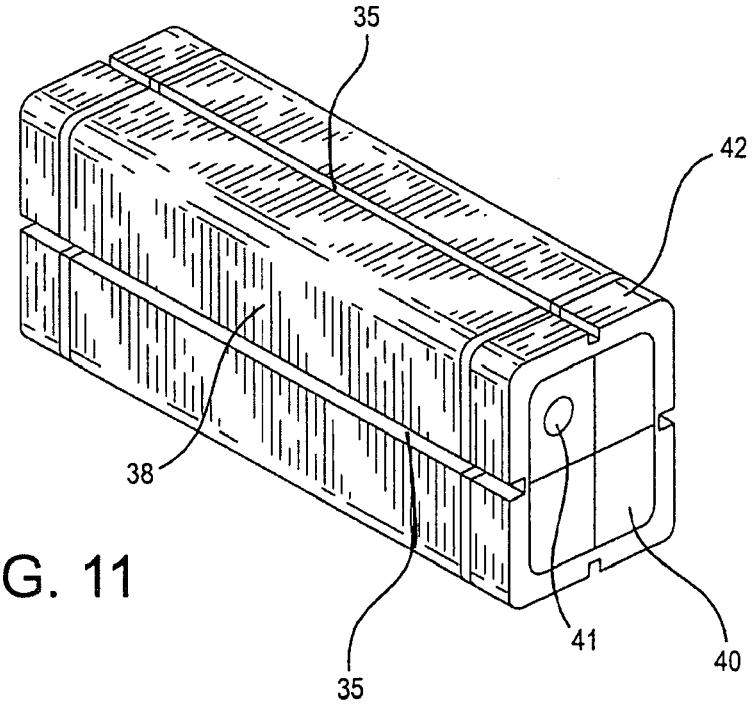
FIG. 11 is a side view of the decoy of FIG. 10, after the uppermost strapped bundle has been released from the remaining bundle (i.e., the lowermost strapped bundle) and has dispersed into the air but before the lowermost strapped bundle has become unstrapped.

One version of the embodiment of the present invention that is discussed immediately above is shown in FIGS. 8-11. In this embodiment of the present invention, the anchoring element or body, shown as 33, is a plate (e.g., a metal or ceramic plate) that is a part of the lowermost strapped bundle 38 of the decoy. This plate also acts as a spacer between the lowermost pyrophoric element in bundle 38 and the piston (not shown). The straps 34 that hold the uppermost strapped handle 37 to the decoy are in contact with anchoring element or body 33 (i.e., straps 34 are tightly pressed against the sides of body 33 and the ends of straps 34 are connected together, for example by twisting or welding, on the far or bottom side of body 33). The straps 35 that hold the lowermost strapped bundle 38 together are also in contact with anchoring element or body 33 (i.e., straps 35 are tightly pressed against the sides of body 33 and the ends of straps 35 are connected together, for example by twisting or welding, on the far or bottom side of body 33). Immediately after the decoy is deployed (i.e., released from the aircraft), the uppermost bundle of pyrophoric elements 36 (which is loose or unstrapped) is released (as shown in FIG. 8) and creates a first infra-red emitting cloud. The release of the uppermost bundle of pyrophoric elements 36 exposes a pyrophoric body 39 located on the surface of the uppermost strapped bundle of pyrophoric elements 37 to air (see FIG. 9). This causes the pyrophoric body 39 to heat up and burn through or melt straps 34, thereby releasing the uppermost strapped bundle 37, which quickly disperses into the air (as shown in FIG. 10) and forms a second infra-red emitting cloud. The release of the uppermost strapped bundle 37 exposes a pyrophoric body 40 located on the surface of the lowermost strapped bundle of pyrophoric elements 38 to air (see FIG. 11). This causes the pyrophoric body 40 to heat up and burn through or melt straps 35, thereby releasing the lowermost strapped bundle 38, which quickly disperses into the air and forms a third infra-red emitting cloud.

In the embodiment of the present invention discussed in the preceding two paragraphs, the pyrophoric body that is used as the means for releasing the bundles at timed intervals can be in any form that is capable of reaching a temperature that is high enough to melt or burn through the straps (i.e., cause the straps to break or fail). The pyrophoric body must also maintain that temperature (or stay above a certain temperature) long enough to melt or burn through the straps to a sufficient degree so that the straps break or fail and release the bundles of pyrophoric elements. Suitable forms for the pyrophoric body are: (1) thin wafers or foils (as shown, in FIGS. 8-11); (2) strips: or (3) pellets of almost any shape. The pyrophoric body must be in contact with or near to the straps that bind the strapped bundle to the anchoring element or body so that the heat from the pyrophoric body (once it is exposed to air) can melt or burn through the straps, thereby causing the straps to break or fall and releasing the bundle of pyrophoric elements. In FIGS. 8-11, the pyrophoric body on the upper surface of bundles 37 and 38 is in the form of a thin wafer or foil (e.g., a thin metal foil that is covered with a pyrophoric coating). The pyrophoric body has a circular through hole 41 (i.e., the hole extends through the pyrophoric body so that the spacer 42 is visible through the hole when viewed from the upper surface of the pyrophoric body), located near to the point where the straps overlap on the upper surface of the pyrophoric body. The purpose of the through hole 41 is to allow air flow through the pyrophoric body 39 so that both sides of the pyrophoric body are exposed to air (i.e., there is some space between the lower or bottom surface of pyrophoric body 39 and some portion of the top surface of the spacer 42 and that space is in communication with the hole 41 and the side hole 43). This increases the surface area of the pyrophoric body that is exposed to oxygen in the air so that the pyrophoric body heats up faster after exposure to air. The spacer 42 is designed to allow air flow through hole 41 in its top surface and out the hole 43 in one side of the spacer to further enhance air flow (see FIG. 9). Placing this through hole 41 near to the point where the straps (i.e., straps 34 for bundle 37 and straps 35 for bundle 38) overlap on the upper surface of the pyrophoric bodies 39 and 40 is not essential but it helps to ensure that the portions of the pyrophoric body that are located near to the point where the straps overlap will rapidly reach a temperature that is high enough to cause the straps to break or fail, thereby releasing the bundle of pyrophoric elements that is bound by those straps.

Figure 12:
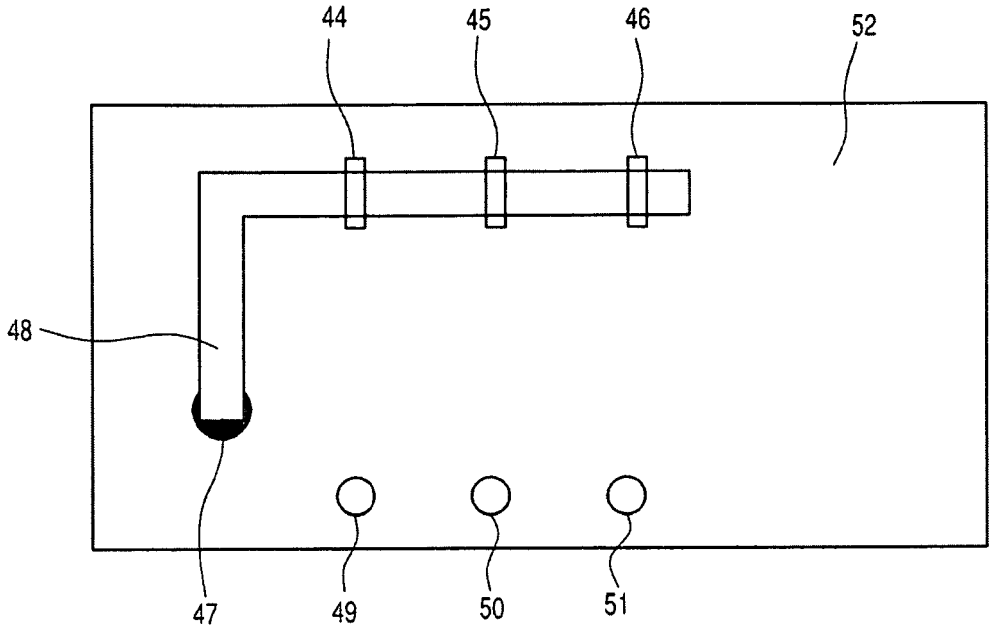
FIG. 12 shows one of the possible arrangements of the anchor loops on the fuse for the decoy embodiment shown in FIG. 1.

FIG. 12 shows another of the many possible configurations of the fuse, straps and anchor loops on the piston for the decoy of FIG. 1. The view in FIG. 12 is of the top surface of the piston 52 (i.e., the surface of the piston that faces the lowermost bundle of pyrophoric elements). In FIG. 12, fuse 48 is located on the top or upper surface of the piston 52, which is the side of the piston that is facing the lowermost bundle of pyrophoric elements of the decoy. One end of the wire strap for each of the three strapped bundles in the decoy of FIG. 1 is permanently attached to the piston. In the embodiment shown in FIG. 12, the end of the wire strap for each of the three strapped bundles is permanently attached to the piston on the bottom surface of the piston (i.e., the surface that is not facing the lowermost bundle of pyrophoric elements; this surface is shown as 7 in FIG. 1). The straps for the three bundles pass through the three through holes 49, 50 and 51 in the upper surface of the piston 52 and are connected to the bottom surface of the piston. One method of connecting the straps to the bottom surface of the piston is to create knots or twists in the end of the strap after the end of the strap has passed through one of the through holes 49, 50 or 51. As long as these knots or twists are of sufficient size so that they cannot pass back through the holes 49, 50 and 51, then the strap is secure and is considered to be connected to the bottom surface of the piston. For the uppermost strapped bundle (the first strapped bundle to be released from the piston, shown as 3 in FIG. 1), the strap would pass through hole 49 in FIG. 12. For the middle strapped bundle (the second strapped bundle to be released from the piston, shown as 2 in FIG. 1), the strap would pass through hole 50 in FIG. 12 and for the lowermost strapped bundle (the last strapped bundle to be released from the piston, shown as 1 in FIG. 1), the strap would pass through hole 51 in FIG. 12.

The other end of the wire straps for the decoy shown in FIG. 1 is attached to the piston by anchor loops, which are shown as 44, 45 and 46 in FIG. 12. These anchor loops pass over the fuse 48 and through the piston and are then connected on the bottom side of the piston (i.e., the side that is not facing the lowermost bundle of pyrophoric elements), for example by tying the two ends of each anchor loop into a knot. The free end of each of the three straps (i.e., the end that is not permanently attached to the bottom surface of the piston) is then connected to an anchor loop (e.g., by tying, twisting of clamping the free end of each strap to or around an anchor loop). The anchor loops are made of a material that will be burned through or melted by the fuse as it burns past them. The position of the attachment of the other end of the wire straps to the anchor loops is not critical, as long as when the anchor loops fail, the wire strap is released and is free to move upward so that the bundle that is held in place by that wire strap is released from the piston. Accordingly, the wire straps themselves could pass through the piston and attach to the anchor loops on the bottom side of the piston. The anchor loops must be strong enough to hold the wire strap under tension until the time of release. This means that the anchor loops must be either attached to the piston itself or they must pass through the piston, and attach to themselves, or to some other body, on the opposite side of the piston.

In the embodiment shown in FIG. 12, one end of the fuse 48 passes through a hole 47 in the piston and is exposed on the bottom side of the piston. When the end of the fuse that is exposed on the bottom side of the piston is lit (e.g., by the detonation of a small explosive charge or squib located at the bottom of the container), the fuse burns in a direction towards the anchor loops 44, 45 and 46. The burning fuse reaches anchor loop 44 first and burns through or melts that anchor loop, causing the release of the uppermost strapped bundle from the piston 52. A short time later, the burning fuse reaches anchor loop 45, and shortly thereafter anchor loop 46, causing the sequential release of the middle strapped bundle and then the lowermost strapped bundle from the piston 52.

The aforementioned examples of means for releasing the bundles from the decoy are just a few of the many possible means that could be used. These examples are intended to be illustrative and should not be used to limit the scope of the invention as defined in the appended claims.

The scope of the present invention should not be limited to the specific examples and descriptions provided in the foregoing specification and appended drawings. An artisan of ordinary skill will readily appreciate the numerous minor modifications that may be made to the present invention without departing from its spirit and scope. Applicants intend to cover all such minor modifications in the present application.

What is claimed is:

1. A decoy for an infra-red radiation seeking device that comprises:

a) an anchoring body;

b) two or more bundles of pyrophoric elements;

c) straps that bind at least two of the bundles to the anchoring body; and d) two or more pyrophoric bodies, wherein each pyrophoric body heats up upon exposure to air and melts or burns at least one strap that binds at least one bundle to said anchoring body thereby causing said at least one strap to break or fail resulting in the release of said at least two bundles from said anchoring body and from said decoy after said decoy has been released from a target, further wherein:

(i) each bundle of pyrophoric elements forms a cloud of pyrophoric elements shortly after release from the decoy and said cloud of pyrophoric elements emits infra-red radiation; and (ii) at least some of the pyrophoric elements comprise a pyrophoric coating on a supporting body, said pyrophoric coating containing at least one pyrophoric powder and a binder.

2. The decoy of claim 1, wherein one of said bundles of pyrophoric elements contains pyrophoric elements that are made of a different material or have a different composition than the pyrophoric elements of another one of the bundles in the decoy.

3. The decoy of claim 1, wherein at least one of the bundles of pyrophoric elements also contains pyrophoric powder.

4. The countermeasure of claim 3, wherein the decoy also contains pyrophoric powder located either:

(a) inside at least one of the bundles of pyrophoric elements, or (b) on top of at least one of the pyrophoric elements; or (c) between two of the bundles of pyrophoric elements.

5. The decoy of claim 1, wherein at least one of the bundles of pyrophoric elements, before release from the decoy, is attached to one or more ribbons of pyrophoric material that unfold when the top of the bundle is exposed to the air and, after unfolding, said ribbons generate infra-red radiation.

6. The decoy of claim 1, wherein at least one of said pyrophoric bodies is a flat plate or foil that is located on the upper surface of one of said bundles of pyrophoric elements and in contact with or located close to said at least one strap that binds the bundle to the anchoring body wherein said flat plate or foil has at least one hole that passes through said flat plate or foil so that air can pass through said at least one hole and contact a bottom surface of said flat plate or foil that is not in contact with and does not face said at least one strap, further wherein a portion of said bottom surface of said flat plate or foil is in contact with a spacer that is shaped so as to permit air to access the portions of the bottom surface of said flat plate or foil that are not in contact with said spacer.

7. The decoy of claim 1, wherein said two or more pyrophoric bodies are disposed within said decoy so that each of said bundles of pyrophoric elements that are bound to the anchoring body by at least one of said straps contain at least one pyrophoric body that is located on the upper surface of the bundle and is in contact with or located close to said at least one strap that binds the bundle to the anchoring body.

8. The decoy of claim 1, wherein at least one of said pyrophoric bodies is a flat plate or foil that is located on the upper surface of one of said bundles of pyrophoric elements and in contact with or located close to said at least one strap that binds the bundle to the anchoring body wherein said flat plate or foil has an upper surface and a bottom surface and the upper surface is in contact with or located close to said at least one strap that binds the bundle to the anchoring body and the bottom surface is not in contact with and does not face said at least one strap, further wherein a portion of said bottom surface of said flat plate or foil is in contact with a spacer that is shaped so as to permit air to access the portions of the bottom surface of said flat plate or foil that are not in contact with said spacer.

9. The decoy of claim 1, wherein for at least some of the pyrophoric elements that comprise a pyrophoric coating on a supporting body, said pyrophoric coating also contains at least one ignitable powder in addition to said at least one pyrophoric powder and said binder.

10. The decoy of claim 9, wherein the pyrophoric elements that comprise a pyrophoric coating comprising at least one ignitable powder in addition to said at least one pyrophoric powder and said binder are formed by applying a dispersion containing the pyrophoric powder, the ignitable powder, the binder and a solvent or carrier to at least a portion of the surface of the supporting body in a nitrogen, reducing or inert atmosphere and then removing at least a portion of the solvent or carrier.

11. The decoy of claim 10, wherein the supporting body is in the form of a foil or web.

12. The decoy of claim 1, wherein the pyrophoric elements that comprise a pyrophoric coating on a supporting body are formed by applying a dispersion containing the pyrophoric powder, the binder and a solvent or carrier to at least a portion of the surface of the supporting body in a nitrogen, reducing or inert atmosphere and then removing at least a portion of the solvent or carrier.

13. The decoy of claim 12, wherein the supporting body is in the form of a foil or web.

14. A countermeasure for an infra-red radiation seeking device comprising, before deployment from a target:

(a) a container; and (b) a decoy, wherein said decoy is disposed in said container and said container is hermetically sealed, further wherein said decoy comprises:

(i) two or more bundles of pyrophoric elements;

(ii) an anchoring body;

(iii) straps that bind at least two of the bundles to the anchoring body; and (iv) two or more pyrophoric bodies; wherein a) said two or more bundles of pyrophoric elements comprise a first bundle and a second bundle;

b) each pyrophoric body heats up upon exposure to air and melts or burns at least one strap that binds at least one bundle to said anchoring body thereby causing the release of said at least two bundles from said anchoring body and from said decoy after said decoy has been released from a target;

c) each of said bundles forms a cloud of pyrophoric elements shortly after release from the decoy and said cloud produces infra-red radiation; and d) at least some of the pyrophoric elements comprise a pyrophoric coating on a supporting body, said pyrophoric coating containing at least one pyrophoric powder and a binder.

15. The countermeasure of claim 14, wherein the decoy also contains one or more ribbons of pyrophoric material that are located between the bundles and are in a folded or compressed state, further wherein the one or more ribbons are attached to the top surface of one or more of the bundles or are attached to spacers or plates that are attached to the top surface of the one or more bundles.

16. The countermeasure of claim 14, wherein for at least some of the pyrophoric elements that comprise a pyrophoric coating on a supporting body, said pyrophoric coating also contains at least one ignitable powder in addition to said at least one pyrophoric powder and said binder.

17. A method of attracting or decoying an infra-red radiation seeking device away from a target comprising ejecting a decoy from the target wherein said decoy comprises:

a) an anchoring body;

b) two or more bundles of pyrophoric elements;

c) straps that bind at least two of the bundles to the anchoring body; and d) two or more pyrophoric bodies, wherein each pyrophoric body heats up upon exposure to air and melts or burns at least one strap that binds at least one bundle to said anchoring body thereby causing said at least one strap to break or fail resulting in the release of said at least two bundles from said anchoring body and from said decoy after said decoy has been released from a target, further wherein:

(i) each of the bundles forms a cloud of pyrophoric elements shortly after release from the decoy and said cloud of pyrophoric elements produce infra-red radiation; and (ii) at least some of the pyrophoric elements comprise a pyrophoric coating on a supporting body, said pyrophoric coating containing at least one pyrophoric powder and a binder.

18. The method of claim 17, wherein for at least some of the pyrophoric elements that comprise a pyrophoric coating on a supporting body, said pyrophoric coating also contains at least one ignitable powder in addition to said at least one pyrophoric powder and said binder.

* * * * *